US007364488B2

(12) United States Patent
Mueller et al.

(10) Patent No.: US 7,364,488 B2
(45) Date of Patent: Apr. 29, 2008

(54) METHODS AND APPARATUS FOR ENHANCING INFLATABLE DEVICES

(75) Inventors: George G. Mueller, Boston, MA (US); Ralph Osterhout, San Francisco, CA (US); Kevin J. Dowling, Westford, MA (US)

(73) Assignee: Philips Solid State Lighting Solutions, Inc., Burlington, MA (US)

( * ) Notice: Subject to any disclaimer, the term of this patent is extended or adjusted under 35 U.S.C. 154(b) by 448 days.

(21) Appl. No.: 10/422,623

(22) Filed: Apr. 24, 2003

(65) Prior Publication Data

US 2004/0116039 A1 Jun. 17, 2004

Related U.S. Application Data

(60) Provisional application No. 60/375,856, filed on Apr. 26, 2002.

(51) Int. Cl.
*A63H 3/06* (2006.01)

(52) U.S. Cl. ..... 446/220; 446/485; 446/224

(58) Field of Classification Search ..... 446/220–226, 446/485, 219, 175; 362/292, 234, 252, 470, 362/253, 806; 385/901, 147, 31; 257/88, 257/89

See application file for complete search history.

(56) References Cited

U.S. PATENT DOCUMENTS 2,542,361 A * 2/1951 Roxburgh ..... 362/362
2,862,531 A * 12/1958 Walkers ..... 141/317
3,229,976 A * 1/1966 Allen, Jr. ..... 473/570
3,283,328 A * 11/1966 Wood ..... 343/706
4,075,472 A * 2/1978 Higuchi ..... 362/255
4,292,999 A * 10/1981 Szollmann ..... 362/253

(Continued)

FOREIGN PATENT DOCUMENTS

DE 3439524 A1 * 4/1986

(Continued)

OTHER PUBLICATIONS

Knisley, Joseph, "The Latest in Lighting", Electrical Wholesaling, Internet—http://ewweb.com/mag/electric_latest_lighting/, 1999.*

(Continued)

*Primary Examiner*—Eugene Kim
*Assistant Examiner*—Urszula M Cegielnik
(74) *Attorney, Agent, or Firm*—Wolf, Greenfield & Sacks, P.C.

(57) ABSTRACT

Methods and apparatus for enhancing an inflatable device. In one example, a first component adapted to generate at least one of light and sound is coupled to a second component that is adapted to facilitate insertion into an inflatable device. The first component may be an LED-based light source configured to generate single or multi-colored light in an interior space of the inflatable device once inserted into the inflatable device. The second component may be particularly configured with one or more valves or seals to facilitate a transfer of a substance (e.g., an inflating substance) into the inflatable device once the first and second components are inserted into the inflatable device. The second component also may be configured to conveniently facilitate an effective seal between the second component and the inflatable device.

20 Claims, 4 Drawing Sheets

U.S. PATENT DOCUMENTS 4,612,720 A * 9/1986 Manners-Smith et al. .... 40/211
4,704,934 A 11/1987 Nosrati
4,717,158 A * 1/1988 Pennisi ..... 473/570
4,801,141 A * 1/1989 Rumsey ..... 273/454
5,102,131 A * 4/1992 Remington ..... 473/570
5,453,405 A * 9/1995 Fan et al. ..... 438/34
5,499,941 A 3/1996 Penjuke, Sr.
5,516,322 A * 5/1996 Myers ..... 446/267
5,609,411 A * 3/1997 Wang ..... 362/363
5,639,076 A * 6/1997 Cmiel et al. ..... 446/220
5,725,445 A * 3/1998 Kennedy et al. ..... 473/570
5,736,954 A * 4/1998 Veazey ..... 342/8
5,779,574 A * 7/1998 Allman et al. ..... 473/570
5,795,211 A * 8/1998 Carignan et al. ..... 446/220
5,888,156 A * 3/1999 Cmiel et al. ..... 473/570
5,902,166 A * 5/1999 Robb ..... 446/485
5,942,770 A * 8/1999 Ishinaga et al. ..... 257/89
5,954,603 A * 9/1999 Chursinoff ..... 473/570
6,007,209 A 12/1999 Pelka
6,012,826 A * 1/2000 Chabert ..... 362/363
6,016,038 A 1/2000 Mueller et al.
6,059,676 A * 5/2000 Seymour et al. ..... 473/570
6,106,135 A * 8/2000 Zingale et al. ..... 446/220
6,146,001 A 11/2000 Cwiakala
6,150,774 A 11/2000 Mueller et al.
6,166,496 A 12/2000 Lys et al.
6,211,626 B1 4/2001 Lys et al.
6,238,067 B1 * 5/2001 Hirsch ..... 362/352
6,243,068 B1 6/2001 Evanicky et al.
6,292,901 B1 9/2001 Lys et al.
6,340,868 B1 1/2002 Lys et al.
6,371,638 B1 4/2002 Zingale et al.
6,428,432 B1 * 8/2002 Kachel ..... 473/570
6,435,688 B1 * 8/2002 Pittman ..... 446/220
6,459,919 B1 10/2002 Lys et al.
6,482,065 B1 * 11/2002 Blackman ..... 446/220
6,528,954 B1 3/2003 Lys et al.
6,548,967 B1 4/2003 Dowling et al.
6,577,080 B2 6/2003 Lys et al.
6,608,453 B2 8/2003 Morgan et al.
6,624,597 B2 9/2003 Dowling et al.
6,679,614 B2 * 1/2004 Pittman ..... 446/219
6,717,376 B2 4/2004 Lys et al.
6,720,745 B2 4/2004 Mueller et al.
6,774,584 B2 8/2004 Lys et al.
6,777,891 B2 8/2004 Lys et al.
6,781,329 B2 8/2004 Morgan et al.
6,788,011 B2 9/2004 Mueller et al.
6,801,003 B2 10/2004 Schanberger et al.
6,806,659 B1 10/2004 Mueller et al.
6,869,204 B2 3/2005 Morgan et al.
6,883,929 B2 4/2005 Dowling
6,888,322 B2 5/2005 Dowling et al.
6,897,624 B2 5/2005 Duchame et al.
6,936,978 B2 8/2005 Morgan et al.
6,965,205 B2 11/2005 Piepgras et al.
6,967,448 B2 11/2005 Morgan et al.
6,969,954 B2 11/2005 Lys
6,975,079 B2 12/2005 Lys et al.
7,031,920 B2 4/2006 Dowling et al.
7,038,398 B1 5/2006 Lys et al.
7,038,399 B2 5/2006 Lys et al.
7,042,172 B2 5/2006 Dowling et al.
2002/0038157 A1 3/2002 Dowling et al.
2002/0048169 A1 4/2002 Dowling et al.
2002/0070688 A1 6/2002 Dowling et al.
2002/0074559 A1 6/2002 Dowling et al.
2002/0078221 A1 6/2002 Blackwell et al.
2002/0089843 A1 * 7/2002 Lou ..... 362/96
2002/0090182 A1 * 7/2002 Clarkin ..... 385/100
2002/0106170 A1 * 8/2002 Davenport et al. ..... 385/901
2002/0118919 A1 * 8/2002 Bruchmann ..... 385/901
2002/0126506 A1 * 9/2002 Syme ..... 362/567
2002/0130627 A1 9/2002 Dowling et al.
2002/0145394 A1 10/2002 Morgan et al.
2002/0145869 A1 10/2002 Dowling
2002/0152045 A1 10/2002 Dowling et al.
2002/0158583 A1 10/2002 Lys et al.
2002/0171927 A1 11/2002 Barnes, III
2002/0176259 A1 11/2002 Ducharme
2003/0011538 A1 1/2003 Lys et al.
2003/0028260 A1 2/2003 Blackwell
2003/0057884 A1 3/2003 Dowling et al.
2003/0057887 A1 3/2003 Dowling et al.
2003/0076281 A1 * 4/2003 Morgan et al. ..... 345/44
2003/0100837 A1 5/2003 Lys et al.
2003/0133292 A1 7/2003 Mueller
2003/0222587 A1 12/2003 Dowling et al.
2004/0036006 A1 2/2004 Dowling
2004/0052076 A1 3/2004 Mueller et al.
2004/0090191 A1 5/2004 Mueller et al.
2004/0090787 A1 5/2004 Dowling et al.
2004/0105261 A1 6/2004 Ducharme et al.
2004/0116039 A1 6/2004 Mueller et al.
2004/0130909 A1 7/2004 Mueller et al.
2004/0174718 A1 * 9/2004 Ohlund ..... 362/565
2004/0178751 A1 9/2004 Mueller et al.
2004/0212320 A1 10/2004 Dowling et al.
2004/0212993 A1 10/2004 Morgan et al.
2004/0228144 A1 * 11/2004 Squicciarini ..... 362/555
2005/0099824 A1 5/2005 Dowling et al.
2005/0116667 A1 6/2005 Mueller et al.
2005/0151489 A1 7/2005 Lys et al.
2005/0213352 A1 9/2005 Lys et al.
2005/0213353 A1 9/2005 Lys
2005/0218838 A1 10/2005 Lys
2005/0218870 A1 10/2005 Lys
2005/0219872 A1 10/2005 Lys
2005/0231133 A1 10/2005 Lys
2005/0236029 A1 10/2005 Dowling
2005/0236998 A1 10/2005 Mueller
2005/0253533 A1 11/2005 Lys et al.
2005/0275626 A1 12/2005 Mueller
2005/0276053 A1 12/2005 Nortrup
2006/0002110 A1 1/2006 Dowling
2006/0012987 A9 1/2006 Ducharme
2006/0016960 A1 1/2006 Morgan
2006/0022214 A1 2/2006 Morgan
2006/0050509 A9 3/2006 Dowling
2006/0076908 A1 4/2006 Morgan
2006/0098077 A1 5/2006 Dowling
2006/0104058 A1 5/2006 Chamel et al.
2006/0109649 A1 5/2006 Ducharme et al.
2006/0132061 A1 6/2006 McCormick et al.
2006/0152172 A9 7/2006 Mueller

FOREIGN PATENT DOCUMENTS

JP 59016392 A * 1/1984
WO WO 200183067 A2 * 11/2001

OTHER PUBLICATIONS

Dornsife, Dana, "Architectronics", Residential Online Systems, Internet—http//resmagonline.com/2001/1201/column_architect.shtml, 2003.*
"Lighting Effect Products", Blue Point Engineering, Internet—http://web.archive.org/web/20020806122029/http://www.bpesolutions.com/lghtefx.html, 2002.*
"Side Emitting", Fibre Light Systems, Internet—http://www.fibrelightus.com/inde.ssp?CTYPE=6&BRACH=2, 2003.*
BALLOONLAMP, http://www.kyouei-ltd.co.jp/page/balloon.html, printed Aug. 11, 2004.

* cited by examiner

METHODS AND APPARATUS FOR ENHANCING INFLATABLE DEVICES

CROSS-REFERENCE TO RELATED APPLICATIONS

This application claims the benefit, under 35 U.S.C. § 19(e), of U.S. Provisional Application Ser. No. 60/375,856, filed Apr. 26, 2002, entitled "Systems and Methods for Lighting Inflatable Devices."

FIELD OF THE INVENTION

The present invention generally relates to methods and apparatus for enhancing inflatable devices, such as balloons, by using light and/or sound.

BACKGROUND

The usefulness of balloons as a novelty item is readily apparent. Balloons are used in the celebration of events, to indicate beginnings and endings, as toys, to grab attention and for many other reasons. Two popular styles of balloons sold on the market today are latex and Mylar. Mylar balloons have the advantage of providing more decorative patterns, symbols, words and the like, and are also made of relatively non-porous material so helium does not pass through as quickly as the latex versions. One of the main reasons consumers purchase Mylar balloons is because of the decorative features. It would be useful to provide a balloon, or other inflatable device, with features that enhance the aesthetics, interactivity, or usefulness of a balloon.

SUMMARY OF THE INVENTION

One embodiment of the invention is directed to an apparatus, comprising at least one first component adapted to generate at least one of light and sound, and at least one second component coupled to the at least one first component and adapted to facilitate insertion of the apparatus into an inflatable device.

Another embodiment of the invention is directed to a method, comprising an act of projecting at least one of light and sound into an interior space of an inflatable device so as to enhance an effect of the inflatable device.

Another embodiment of the invention is directed to an illumination method, comprising an act of inserting at least one LED-based light source into an inflatable device such that light, when generated by the at least one LED-based light source, is projected into an interior space of the inflatable device.

Another embodiment of the invention is directed to an apparatus, comprising at least one LED-based light source configured to generate variable multi-colored light, and a platform on which the at least one LED-based light source is disposed. The platform is configured to facilitate insertion of the apparatus into an inflatable device, such that when the apparatus is inserted into the inflatable device, the variable multi-colored light, when generated, is projected into an interior space of the inflatable device.

It should be appreciated the all combinations of the foregoing concepts and additional concepts discussed in greater detail below are contemplated as being part of the inventive subject matter disclosed herein. In particular, all combinations of claimed subject matter appearing at the end of this disclosure are contemplated as being part of the inventive subject matter.

The following patents and patent applications are hereby incorporated herein by reference:

U.S. Pat. No. 6,016,038, issued Jan. 18, 2000, entitled "Multicolored LED Lighting Method and Apparatus;"

U.S. Pat. No. 6,211,626, issued Apr. 3, 2001 to Lys et al, entitled "Illumination Components,"

U.S. patent application Ser. No. 09/870,193, filed May 30, 2001, entitled "Methods and Apparatus for Controlling Devices in a Networked Lighting Apparatus;"

U.S. patent application Ser. No. 09/344,699, filed Jun. 25, 1999, entitled "Method for Software Driven Generation of Multiple Simultaneous High Speed Pulse Width Modulated Signals;"

U.S. patent application Ser. No. 09/805,368, filed Mar. 13, 2001, entitled "Light-Emitting Diode Based Products;"

U.S. patent application Ser. No. 09/663,969, filed Sep. 19, 2000, entitled "Universal Lighting Network Methods and Apparatuss;"

U.S. patent application Ser. No. 09/716,819, filed Nov. 20, 2000, entitled "Apparatuss and Methods for Generating and Modulating Illumination Conditions;"

U.S. patent application Ser. No. 09/675,419, filed Sep. 29, 2000, entitled "Apparatuss and Methods for Calibrating Light Output by Light-Emitting Diodes;"

U.S. patent application Ser. No. 09/870,418, filed May 30, 2001, entitled "A Method and Apparatus for Authoring and Playing Back Lighting Sequences;"

U.S. patent application Ser. No. 10/045,629, filed Oct. 25, 2001, entitled "Methods and Apparatus for Controlling Illumination;"

U.S. patent application Ser. No. 10/158,579, filed May 30, 2002, entitled "Methods and Apparatus for Controlling Devices in a Networked Lighting Apparatus;"

U.S. patent application Ser. No. 10/325,635, filed Dec. 19, 2002, entitled "Controlled Lighting Methods and Apparatus;" and U.S. patent application Ser. No. 10/360,594, filed Feb. 6, 2003, entitled "Controlled Lighting Methods and Apparatus."

BRIEF DESCRIPTION OF THE FIGURES

The following figures depict certain illustrative embodiments of the invention in which like reference numerals refer to like elements. These depicted embodiments are to be understood as illustrative of the invention and not as limiting in any way.

DETAILED DESCRIPTION

Figure 1:
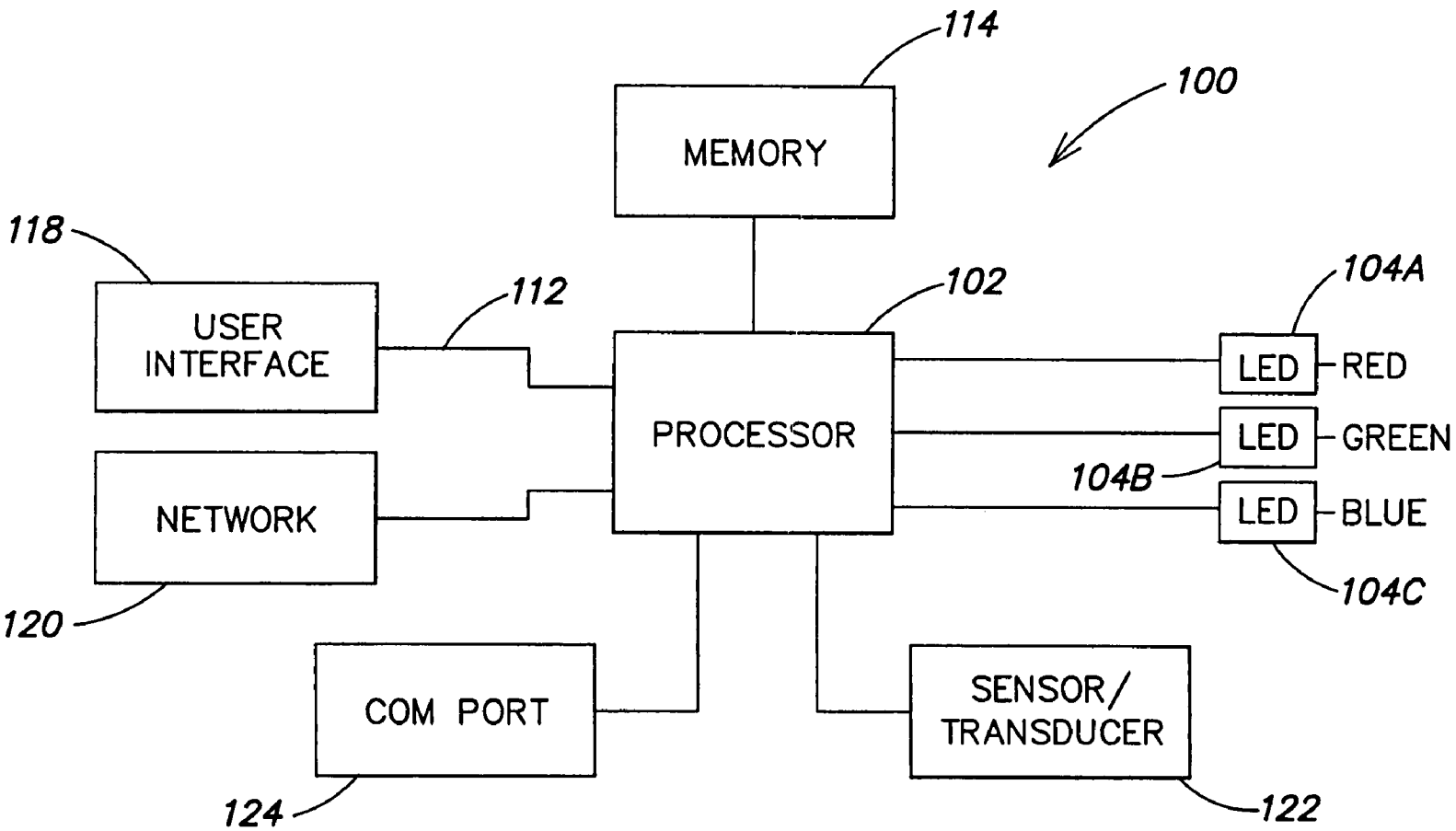
FIG. 1 illustrates a lighting module according to the principles of the present invention.

The description below pertains to several illustrative embodiments of the invention. Although many variations of the invention may be envisioned by one skilled in the art, such variations and improvements are intended to fall within the compass of this disclosure. Thus, the scope of the invention is not to be limited in any way by the disclosure below.

The present invention is directed generally to methods and apparatus for enhancing an inflatable device. For example, according to various embodiments of the invention, an inflatable device (e.g., a balloon) may be enhanced by associating one or both of light and sound with the inflatable device. In various aspects, the light and/or sound associated with the inflatable device may be predetermined and essentially static (e.g., single color, single sound or sound pattern), predetermined and variable (e.g., multi-color light effects, multiple sound effects), or configured to be responsive to user selection and control as well as various environmental conditions (e.g., light and/or sound conditions in the environment around the inflatable device).

More specifically, one embodiment of the invention is directed to an apparatus for lighting a balloon or other inflatable device. The apparatus may be arranged to light the balloon from the inside by fitting into the neck or other portion of the balloon. In an embodiment, the apparatus may include a semiconductor lighting device (e.g. an LED) and the LED may be powered by an internal power supply (e.g. battery). The apparatus may also include a gas exchange passage where a gas can be passed through the apparatus into the balloon. For example, the gas exchange passage may pass from an external portion of the apparatus to a portion of the apparatus that is internal to the balloon. Gas (e.g. helium from a helium tank) may be passed through the gas exchange passage to pressurize the balloon. Once the balloon is properly pressurized, the gas exchange passage may be sealed, enclosed or otherwise arranged to prevent the pressurized gas from escaping the balloon interior. In an embodiment, the gas exchange passage may include a valve or other sealing apparatus. In an embodiment, the sealing apparatus may be self-sealing and in another embodiment, the sealing apparatus may require intervention from a user to create the seal.

A lighting apparatus according to the present invention may be used to light balloons of most any type including latex, Mylar or other style balloons. In an embodiment, the lighting apparatus may be adapted to generate a particular color (e.g. red, green, blue, or white) or the lighting apparatus may be adapted to generate color changing effects, temporal effects, adjustable colors, adjustable effects or selectable colors or effects. The apparatus may be equipped with a sensor such that the hue, saturation, brightness, rate of change or other parameter of the light may be changed in response to communication signals or environmental conditions. For example, the lighting apparatus may include an audio sensor (e.g. microphone) and the light emitted from the lighting apparatus may be altered in response to audio input. The audio apparatus may be associated with a processor wherein the processor is adapted to filter the received audio or perform signal processing such that different sounds generate different lighting effects. Children's high pitched voices may cause the balloons to change in beat with the activity while a base tone may generate the lighting apparatus to generate saturated red, so a parent can make a dramatic entrance into the party by making a deep-voiced entrance. In an embodiment, the light intensity or color may be controlled through the intensity of the sound in the environment. For example, the louder the kids get at the party, the brighter the balloons become, they change colors, generate certain patterns, or the rate of changing patterns is altered. In an embodiment, the lighting apparatus may include an inertia or motion sensor and the lighting effects may change in response to movements of the balloons. For example, when you 'bang' the balloon it generates an effect.

A balloon lighting device according to the present invention may include one or more preprogrammed lighting effects. Memory in the lighting apparatus may include one or more lighting effects and a user interface, sensor, network controller, or other apparatus may be used to select and/or alter a lighting effect from memory. For example, a user interface may be associated with the lighting apparatus to allow a user to select a particular lighting effect. The user interface may be integral to the lighting apparatus or may be remotely accessed through wireless communication, such that lighting effects produced by the lighting apparatus, once disposed in the inflatable device, may be controlled remotely.

In an embodiment, a lighting apparatus may be constructed with a lightweight design such that a balloon filled with light gas (e.g. hot air, helium, hydrogen, methane, or natural gas) and/or other materials (e.g., solids such as confetti) can lift the lighting apparatus. Such a lighting apparatus may be made of lightweight materials and/or constructed with lightweight characteristics. For example, the lighting apparatus may be made with a plastic housing and the plastic housing may have cut outs to reduce the weight. The number of batteries in the apparatus may be kept to a minimum to reduce the weight and the amount of energy the LED(s) consume may be kept to a minimum to increase the battery life.

In an embodiment, a lighted tether is attached to a lighting apparatus. The lighted tether may be used in combination with the lighted balloon section of a lighting apparatus or the lighted tether may be the only lighted section. A lighted tether could be attached to a lighting apparatus and the light from the lighting apparatus may be optically coupled to the tether. For example, the tether may be used as a light pipe such that the light is projected through the tether and the tether may be made of side emitting or end emitting material such that the light emits from the tether. With side emitting fiber, for example, the tether would appear to glow along its length. The lighting apparatus could be arranged to light the tether with a particular color or color changing effect as described herein.

FIG. 1 illustrates a lighting module 100 that may be incorporated into a lighting apparatus according to the principles of the present invention. Lighting module 100 may include one or more LEDs 104A, 104B, and 104C. In an embodiment, the LEDs 104A, 104B, and 104C may produce different colors (e.g. 104A red, 104B green, and 104C blue). The lighting module 100 may also include a processor 102 wherein the processor 102 may independently control the output of the LEDs 104A, 104B, and 104C. The processor may generate control signals to run the LEDs such as pulse modulated signals, pulse width modulated signals (PWM), pulse amplitude modulated signals, analog control signals or other control signals to vary the output of the LEDs. In an embodiment, the processor may control other circuitry to control the output of the LEDs. The LEDs may be provided in strings of more than one LED that are controlled as a group and the processor 102 may control more than one string of LEDs. A person with ordinary skill in the art would appreciate that there are many apparatus and methods that could be used to operate the LED(s) and/or LED string(s) and the present invention encompasses such apparatus and methods.

A lighting module 100 according to the principles of the present invention may generate a range of colors within a color spectrum For example, the lighting module 100 may be provided with a plurality of LEDs (e.g. 104A-C) and the processor 102 may control the output of the LEDs such that the light from two or more of the LEDs combine to produce a mixed colored light. Such a lighting module may be used in a variety of applications including displays, room illumination, decorative illumination, special effects illumination, direct illumination, indirect illumination or any other application where it would be desirable. Many such lighting modules may be networked together to form large networked lighting applications.

The lighting module 100 may also include memory 114 wherein one or more lighting programs and/or data may be stored. The lighting module 100 may also include a user interface 118 used to change and/or select the lighting effects displayed by the lighting module 100. The communication between the user interface and the processor may be accomplished through wired or wireless (e.g., RF 112) transmission. The lighting module 100 may also be associated with a network such that the lighting module 100 responds to network data. For example, the processor 102 may be an addressable processor that is associated with a network 120. Network data may be communicated through a wired or wireless network and the addressable processor may be 'listening' to the data stream for commands that pertain to it. Once the processor 'hears' data addressed to it, it may read the data and change the lighting conditions according to the received data. For example, the memory 114 in the lighting module 100 may be loaded with a table of lighting control signals that correspond with data the processor 102 receives. Once the processor 102 receives data from a network, user interface, or other source, the processor may select the control signals that correspond to the data and control the LED(s) accordingly. The received data may also initiate a lighting program to be executed by the processor 102 or modify a lighting program or control data or otherwise control the light output of the lighting module 100. In another embodiment, the processor 102 may be a non-networked processor. The microprocessor may be associated with memory 114 for example such that the processor executes a lighting program that was stored in memory.

The lighting module 100 may also include sensors and/or transducers 122 and/or other signal generators (collectively referred to hereinafter as sensors). The sensors may be associated with the processor 102 through wired or wireless transmission apparatus. Much like the user interface and network control apparatus, the sensor(s) may provide signals to the processor and the processor may respond by selecting new LED control signals from memory 114, modifying LED control signals, generating control signals, or otherwise change the output of the LED(s).

In an embodiment, the lighting module may include a transmitter wherein the transmitter is associated with the processor 102. The transmitter may be used to communicate signals from one lighting module to another or to a device other than another lighting module.

While the LEDs 104A, 104B, and 104C in FIG. 1 are indicated as red, green and blue, it should be understood that the LED(s) in an apparatus according to the present invention might be any color including white, ultraviolet, infrared or other colors within the electromagnetic spectrum. As used herein, the term "LED" should be understood to include light emitting diodes of all types, light emitting polymers, semiconductor dies that produce light in response to current, organic LEDs, electro-luminescent strips, and other such apparatus. In an embodiment, an "LED" may refer to a single light emitting diode having multiple semiconductor dies that are individually controlled. It should also be understood that the term "LED" does not restrict the package type of the LED. The term "LED" includes packaged LEDs, non-packaged LEDs, surface mount LEDs, chip on board LEDs and LEDs of all other configurations. The term "LED" also includes LEDs packaged or associated with material (e.g. a phosphor) wherein the material may convert energy from the LED to a different wavelength.

The term "illuminate" should be understood to refer to the production of a frequency of radiation by an illumination source. The term "color" should be understood to refer to any frequency of radiation within a spectrum; that is, a "color," as used herein, should be understood to encompass frequencies not only of the visible spectrum, but also frequencies in the infrared and ultraviolet areas of the spectrum, and in other areas of the electromagnetic spectrum.

Figure 2B:
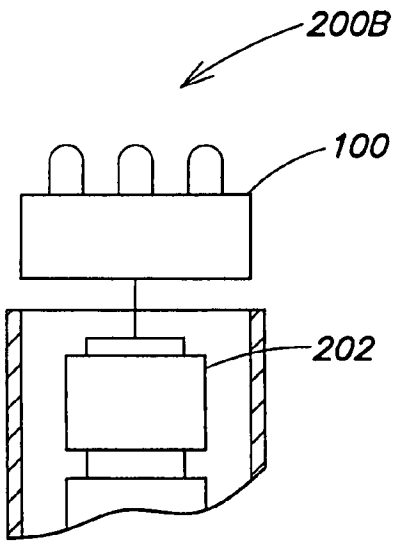
FIGS. 2A and 2B illustrate examples of lighting apparatus according to the principles of the present invention for use in inflatable devices.
Figure 2A:
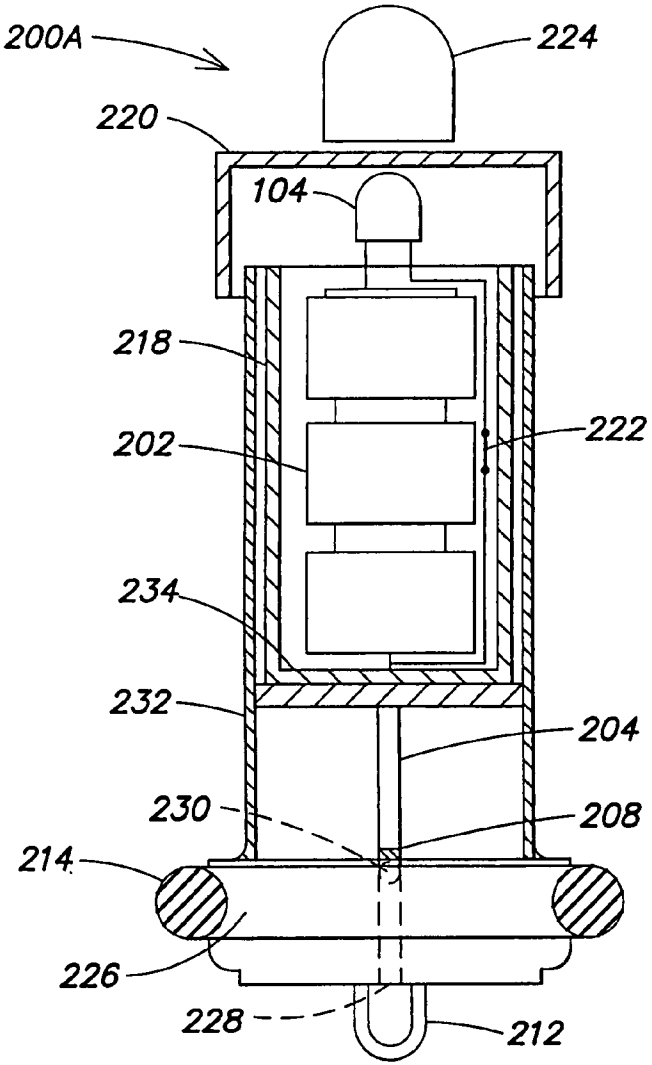

FIGS. 2A and 2B illustrate lighting apparatus 200A and 200B according to the principles of the present invention. The lighting apparatus 200B may include a lighting module 100 as discussed above in connection with FIG. 1, whereas the lighting apparatus 200A may be arranged to energize one or more LED(s) 104 without the aid of a processor. In other respects discussed in further detail below, the lighting apparatus 200A and 200B may be configured similarly. In the discussion below, various features of these lighting apparatus are highlighted with reference to the more detailed drawing of FIG. 2A. Again, it should be appreciated that the various features shown in FIG. 2A also may be employed in the apparatus of FIG. 2B.

In an embodiment, the lighting apparatus 200A and 200B (using 200A as an illustrative example) include a housing or platform 232. The platform 232 may be adapted to contain one or more batteries 202. In the example illustrated in FIG. 2A, the platform supports three stacked batteries. In an embodiment, the stack may include three LR44 batteries to supply the required voltage and power requirements for a particular life expectancy. The lighting apparatus may also include a power switch 222 for energizing and de-energizing the lighting apparatus. The batteries may be housed in a container 218 wherein the container has a closed bottom portion 234. The closed bottom portion may include an electrical contact (not shown) to make contact with the battery. The lighting apparatus may also include a cap 220 to contain the top portion of the housing. The cap 220 may be adapted to be attached to the housing 232 such that the batteries or other components retained by the housing 232 are fully contained. The cap 220 may be arranged to allow the LED(s) 104 to radiate from the apparatus. The cap 220 may be adapted with a hole to allow the LED(s) 104 to pass through the cap.

While many of the embodiments described herein teach of lighting party balloons, it should be understood that a device according to the principles of the present invention may be used to light many types of inflatable devices (e.g., large inflatable balloons, party balloons, latex balloons, rubber balloons, Mylar balloons, balloons capable of lifting heavier objects or weights, inflatable toys, remote controlled blimp style toys or any other object where lighting effects are desirable or useful). It should also be appreciated that according to various embodiments of the invention, lighted inflatable devices may be inflated with one or more various gases and/or solids. For example, in one embodiment, one or more reflective or refractive materials (e.g., confetti) may be placed into an inflatable device so as to interact with the light when generated.

In an embodiment, the lighting apparatus 200A and 200B may include an optic 224. An optic 224 may be associated with the LED(s) 104 to allow for the refinement of the beam pattern from the LED(s) 104. The optic may be arranged to spread or focus the beam of light from the LEDs to better illuminate a balloon of other surface for example.

In an embodiment, the lighting apparatus 200A and 200B may include a gas exchange passage 204. The gas exchange passage may be arranged such that gas can be passed from the exterior of a balloon to the interior of the balloon. The passage 204 may include an inlet 228 and an outlet 230. A gas pressure may be applied to the inlet 228 to force the gas into the balloon through the outlet 230. In an embodiment, the passage may also include a valve or seal 208. The seal may be a self-sealing mechanism or may require user intervention to create the seal. For example, the seal 208 may include a spring loaded seal such that pressure applied to the inlet 228 opens the seal 208 and the seal automatically closes when the pressure is removed. The pressure required to open the seal may be less than the pressure produced by human breath or an artificial inflation device (e.g. a pump or pressurized gas tank). The self-sealing valve may be adapted to open when pressure from a helium tank is supplied, for example. In another embodiment, the seal 208 may seal under internal pressure from the balloon as it is filled with gas. In yet another embodiment the seal may require user intervention to seal (e.g. a seal requiring a twist, push or a secondary cap).

In an embodiment, the lighting apparatus 200A and 200B may include a balloon sealing mechanism 214. For example, the housing 232 may include a recessed portion 226. A balloon may be slipped over the housing 232 including over the recessed portion 226 and an O-ring seal 214 may be slipped over the outer portion of the balloon such that a seal is made between the balloon and the housing 232. In an embodiment, the housing may have an outer diameter such that it adequately seals to the balloon. In an embodiment, the housing 232 may include a protruding portion designed to seal the balloon/housing interface. In an embodiment, a clamp, cap, tie or the like may be provided to seal the apparatus.

In an embodiment, the lighting apparatus 200A and 200B may include a user interface 118 wherein the user interface 118 is used to select or alter a lighting effect generated by the lighting apparatus. In an embodiment, the user interface may be used to select a program from memory 114, modify a program in memory, or modify the playback of a program. For example, the memory 114 may have one or more preprogrammed lighting shows and one or more of the lighting shows may include a variable parameter. A user may activate the user interface to select one of the programs and the same interface, or other interface, may be used to adjust a variable parameter. The user interface may select a program when momentarily activated and adjust a parameter when activated for longer then a predetermined period of time. Of course, a second user interface could be used to provide multiple functions. One of the modes to be selected may be an off mode to allow the user interface to be used as a power switch is as well as a tool to select and/or modify lighting programs. In another embodiment, a power switch may be provided to turn the apparatus on and off while the user interface adjusts and/or selects lighting programs. In another embodiment, a power switch may be included to turn the power on and off wherein the processor monitors the power conditions and selects and/or modifies a lighting program according to the power conditions. For example, the processor may monitor the power cycle period (e.g. the time it takes to turn the apparatus off and back on) and the processor may select a new lighting program from memory 114 if the cycle is performed in less then a predetermined period.

Figure 3:
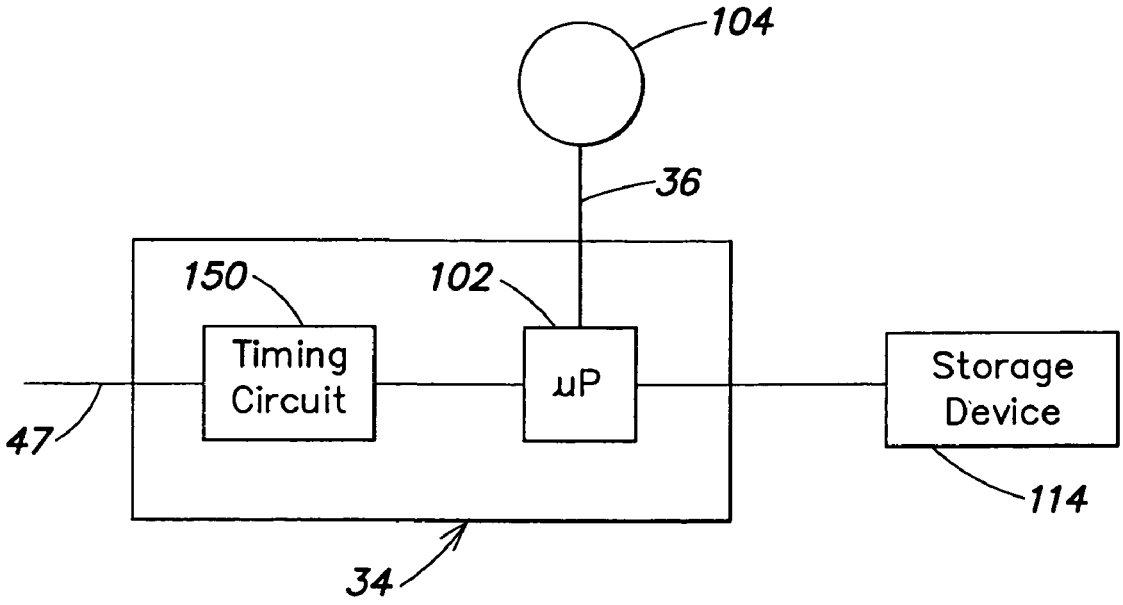
FIG. 3 illustrates a portion of a apparatus according to one embodiment of the invention that facilitates control of one or more light sources via one or more interruptions in a power signal supplied to a processor.

FIG. 3 is a diagram of a control device 34 illustrating a processor 102 according to one embodiment of the invention that facilitates control of one or more light sources 104, via one or more interruptions in the power signal 47 supplied to the processor 102. In one aspect of this embodiment, the feature of controlling one or more light sources via interruptions in power may provide an alternative solution for controlling illumination conditions in an environment, by simply toggling a power switch to one or more light source. Hence, according to one aspect of this embodiment, other types of user interfaces may be unnecessary. According to one aspect of this embodiment, with reference to FIG. 3, the processor 102 may be adapted to control the light source(s) 104 based on one or more interruptions in the power signal 47 supplied to the processor 102. In this sense, the processor 102 processes the power signal 47 such that the power signal 47 serves as an external control signal. In another aspect of this embodiment, the processor 102 may be adapted to control the light source(s) 104 based on one or more interruptions in the power signal 47 having an interruption duration that is less than or equal to a predetermined duration. In yet another aspect of this embodiment, if the interruption duration of an interruption in the power signal 47 is greater than the predetermined duration, the processor 102 does not effect any changes in the radiation output by the light source 104. In particular, according to one embodiment as illustrated in FIG. 3, the processor 102 may include a timing circuit 150 to receive as an input the power signal 47. In one aspect, the processor 102 also may include one or more microprocessors, coupled to the timing circuit 150, to provide one or more control signals 36 to the light source(s) 104 based on the monitored power signal 47. In another aspect, the timing circuit 150 may include an RC circuit (not shown explicitly in FIG. 3) having one or more capacitors that maintain a charge based on the application of the power signal 47 to the timing circuit 150. In this aspect, a time constant of the RC circuit may be particularly selected based on a desired predetermined duration of an interruption in the power signal 47 that causes the processor 102 to effect some change in the radiation output by the light source(s) 104.

For example, according to one aspect of this embodiment, the processor 102 may be adapted to modify one or more variable parameters of one or more illumination programs based on interruptions in the power signal 47 having less than or equal to the predetermined duration. Alternatively, in another aspect of this embodiment, if a number of illumination programs are stored in a storage device 114 coupled to the processor 102, the processor 102 may be adapted to select and execute a particular illumination program based on one or more interruptions in the power signal 47 having less than or equal to the predetermined duration. More specifically, in one aspect of this embodiment, the processor 102 may be adapted to select and execute different illumination programs stored in the storage device 114 based on successive interruptions in the power signal 47. In this aspect, each illumination program stored in the storage device may be associated with one identifier in a sequence of identifiers (e.g., program 1, program 2, program 3, etc.). The processor 102 may be adapted to sequentially select and execute a different illumination program, based on the sequence of identifiers assigned to the programs, by toggling through the different illumination programs with each successive interruption of the power signal 47 having a duration of less than or equal to the predetermined duration. Further-more, according to another aspect of this embodiment, if an interruption in the power signal is greater than the predetermined duration, the processor 102 may be adapted not to select and execute a different illumination program, but rather execute the last illumination program selected before the interruption in the power signal that was greater than the predetermined duration (i.e., the illumination program selection will not change on a power-up following interruption in the power signal of a significant duration).

More specifically, in the embodiment shown in FIG. 3, upon power-up, the processor 102 may periodically monitor the timing circuit 150. If the microprocessor 102 detects a logic high value output by the timing circuit 150 (i.e., the most recent interruption in the power signal 47 was less than the predetermined duration, such that an RC circuit of the timing circuit 150 remained "charged-up"), the microprocessor 102 selects a new illumination program from the storage device 114. However, if the processor 102 detects a logic low value output by the timing circuit 150 (i.e., the most recent interruption in the power signal 47 was greater than the predetermined duration, such that an RC circuit of the timing circuit 150 was able to significantly discharge), the processor 102 does not select a new illumination program, but rather begins to execute the illumination program that was selected prior to the most recent interruption in the power signal 47.

Another embodiment of the present invention is directed to a method of indicating to a user, via the color radiation generated by one or more light sources, that a particular illumination program of a number of illumination programs has been selected. For example, one or more storage devices associated with a processor 102 that controls radiation generated by the light source(s) 104 may store a number of illumination programs. As discussed above, successive interruptions of the power signal 47 provided to the processor 102 may be used to toggle through the illumination programs stored on the storage device, so as to select and execute a particular illumination program. Additionally, a remote user interface 118 may be used to select a particular illumination program from a I number of such programs stored on the storage device 114. In some cases, as a user toggles through multiple illumination programs in order to select a particular illumination program, it may not be immediately apparent to the user which illumination program is selected at any given time. For example, a particular illumination program may be designed such that, when executed, the radiation output from one or more light sources is gradually varied at some predetermined rate to transition between a number of different colors in succession throughout the visible spectrum. An example of such an illumination program is a "color wash" program, as discussed above, which more generally may be referred to as a "dynamic color variation program" having a color variation speed. The color variation speed of such a dynamic color variation program may be either a predetermined or variable parameter of the program. For example, in one case, the color variation speed of the "color wash" illumination program may be predetermined such that the radiation generated by one or more light sources slowly varies in color upon execution of the program to create a soothing varying color illumination effect.

In the current example, it should be appreciated that if a user toggles through a number of illumination programs, including the "color wash" program, the user may not immediately realize that they have selected a dynamic color variation program, such as a color wash program with a slow color variation speed, if they are quickly toggling through the programs. Accordingly, in one embodiment of the invention, one or more variable parameters of a particular illumination program are temporarily modified so as to indicate to the user that the particular illumination program has been selected.

For example, in one aspect of this embodiment, a color variation speed of a dynamic color variation program, such as the "color wash" program, may be temporarily increased upon selection and initial execution of the program to indicate to the user that the program has been selected. In this manner, as a user toggles through a number of illumination programs including dynamic color variation programs, the user is able to more readily realize the selection of such a dynamic color variation program. In the case described above in connection with the color wash program, in one aspect of this embodiment, upon selection of the color wash program, a color of the radiation generated by one or more light sources is rapidly changed for a short period of time upon selection of the program (e.g. 1 to 10 seconds), after which the color variation speed may be automatically decreased to the intended programmed speed (e.g., some nominal color variation speed so as to produce a soothing gradual dynamic color effect).

In the foregoing embodiment, it should be appreciated that a method of indicating to a user the selection of a particular illumination program, via variable color radiation output by one or more light sources, may be used in connection with any of a variety of a dynamic color variation programs including, but not limited, the color wash program described above. Additionally, it should be appreciated that according to other embodiments, the color variation speed of a dynamic color variation program need not be changed, but rather any pattern of radiation may be used (e.g., fast flickering of one or more particular colors) to signify the selection of a particular program.

Figure 5:
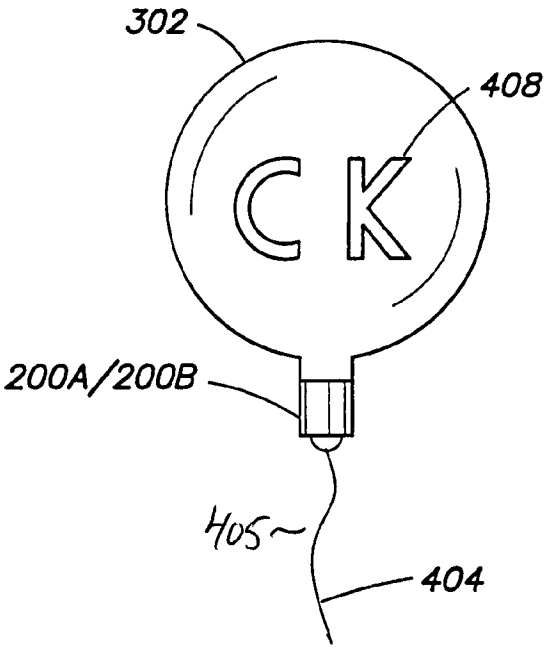
FIG. 5 illustrates a balloon apparatus according to the principles of the present invention.

In an embodiment, the lighting apparatus 200A and 200B shown in FIG. 2 may include a tether attachment feature 212. The feature may be a hook, eyelet other feature designed to hold a tether 404, as shown in FIG. 5. The tether may be a string, line, rope, wire, fiber, fiber optic material, or other tether designed to hold the balloon. In an embodiment, the tether may be lit from the lighting apparatus. For example, the tether may be formed as a fiber using a side emitting fiber material 405 where the light from the lighting apparatus is directed into the fiber. The light may enter the fiber from an end in the lighting apparatus housing 232 and radiate from the tether to produce a glowing tether.

In an embodiment a tether may be provided and adapted as a 'pull chain' user interface to change the lighting effects or activate and de-activate the apparatus.

Figure 4:
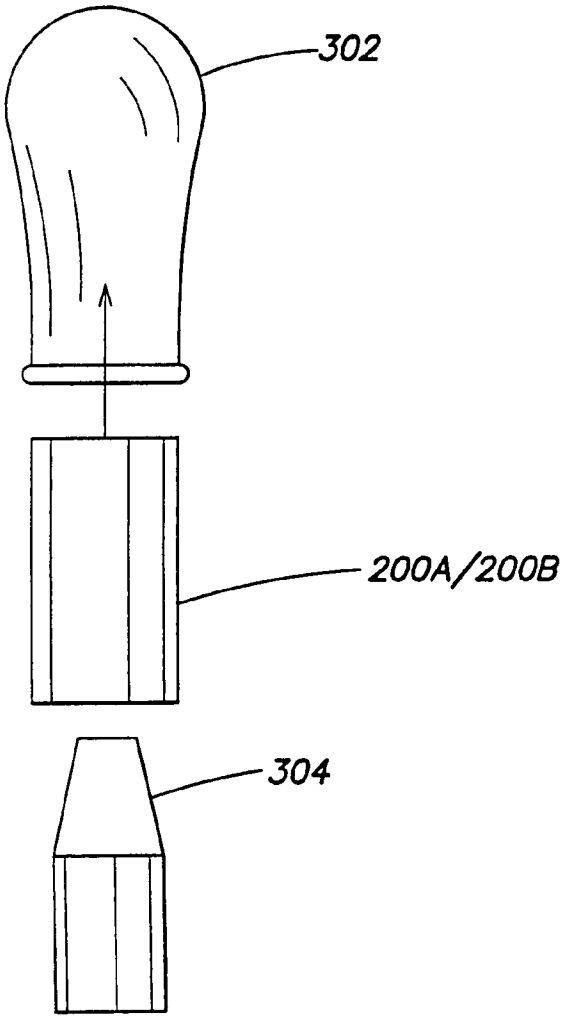
FIG. 4 illustrates a method and apparatus according to the principles of the present invention for inserting the apparatus of FIGS. 2A and 2B into an inflatable device.

FIG. 4 illustrates a apparatus and method of using a apparatus according to the present invention. The lighting apparatus 200A or 200B may be inserted into a balloon 302. The nozzle 304 from a pressurization apparatus (e.g. helium tank) may be used to pressurize the balloon 302 through the lighting apparatus 200A or 200B.

In an embodiment as shown in FIG. 5, a balloon may be provided with a pattern 408. The pattern may be translucent transparent or opaque to assist in the generation of lighting effects. For example, the pattern 408 may be translucent or transparent and the light generated inside of the balloon may transmit through the pattern 408. In another embodiment, the pattern 408 may be opaque while the balloon surface around the pattern 408 may be transparent or translucent allowing the pattern to block light generated by the lighting apparatus. In an embodiment, the pattern 408 may have more than one color such that the light generated by the lighting apparatus transmits differently in different sections depending on the color of the pattern 408 and the color of the light emitted by the lighting apparatus. A apparatus according to the principles of the present invention may be used to generate the appearance of color changing patterns 408 through the color changing light emitted from the lighting apparatus.

Apparatus according to the principles of the present invention may be used as interactive balloons used in parties, parades and other venues. For example, the balloons may be equipped with sensors and/or transmitters such that communication with the balloons is possible. External transmitters may be used to communicate lighting instructions to the balloons and the balloons may respond by changing colors or changing light effects. The lighting apparatus within the balloons may include transmitters so they can communicate with balloons or other devices. For example, one balloon may communicate with balloons within an area to keep balloons in the area in coordination. The transmitting balloon may communicate signals to change all of the local balloons to continuously change colors at a particular rate for example. Balloons make excellent audio transducers and the balloon lighting apparatus may be equipped with an audio sensor. The color may change in accordance with an audio input. The processor may be equipped with signal processing capabilities such that certain sounds generate certain effects. For example, filters may be applied such that the audio spectrum can be broken up into blocks and particular lighting effects may be generated in accordance to the blocks, or intensity of the sound within the blocks. In an embodiment, the processor may be capable of more sophisticated digital processing techniques to provide more control over the lighting effects. In an embodiment, the processor may be arranged to respond to voice commands.

In an embodiment, a first balloon may be adapted as a master wherein it transmits control signals to other devices. The other devices may be other balloons or other non-balloon devices. The devices adapted to receive the control signals may respond to data, frequency, intensity or other parameters of the control signal. For example, the master may communicate a relatively weak signal that is measurably lower as the distance from the master increases. In an embodiment, the slave balloons may be adapted to respond to the data and/or the strength of the control signal. For example, a slave balloon may receive a relatively strong signal and generate a particular effect in response, while another balloon at a greater distance from the master, receives a weaker signal and generates a different response. In an embodiment, this style of communication could be used to generate lighting effects that appear to move through a group of balloons. For example, the control signal may include data indicating that the slave balloons should generate a gradually changing lighting effect (e.g. gradually change from red, to green, to blue) and the timing of the generation within each slave may correlate to the strength of the signal, so the slave balloons that are farther away from the master begin the transition from red after the slave balloons that are closer to the master. In an embodiment, this technique could be used to generate moving patterns of light where the master is at the epicenter of the activity with effects moving from the master or towards the master. In an embodiment, the master balloon could be arranged at the center of a particular event (e.g. the birthday boy at his party) and all of the slave balloons in the room may be generating color changing effects that appear to chase towards or from the center.

In an embodiment, a balloon may be adapted to generate a lighting effect in response to a lighting effect generated in an adjacent balloon. For example, a first balloon may increase in intensity or change color or generate a sound and a second balloon may respond by changing its lighting effect. In an embodiment, a balloon may be adapted to respond to external stimulus or external environmental conditions. For example, the lighting devices may be equipped with a light detector and they may be arranged to be off when the light level in the room is high or on when the light level in the room is low.

While many of the embodiments illustrated herein teach of lighted balloons, it should be understood that a device according to the principles of the present invention may be adapted to generate sound as well as, or rather than, light. The device could be equipped with a sound apparatus (e.g. speaker or other sound apparatus) and the speaker may be associated with the processor 102.

While many of the embodiments illustrated herein describe apparatus for illuminating balloons, it should be understood that apparatus according to the present invention may be used to light other inflatable devices besides balloons. For example, such a apparatus may be used to light an inflatable figurine, model, sculpture, ornament, figure, statue, decoration, ball, puck or other inflatable device.

Having thus described several illustrative embodiments of the invention, various alterations, modifications, and improvements will readily occur to those skilled in the art. Such alterations, modifications, and improvements are intended to be within the spirit and scope of the invention. While some examples presented herein involve specific combinations of functions or structural elements, it should be understood that those functions and elements may be combined in other ways according to the present invention to accomplish the same or different objectives. In particular, acts, elements and features discussed in connection with one embodiment are not intended to be excluded from a similar or other roles in other embodiments. Accordingly, the foregoing description is by way of example only, and is not intended as limiting.

The invention claimed is:

1. An apparatus, comprising:

at least one first component adapted to generate at least one of light and sound; and at least one second component coupled to the at least one first component and adapted to facilitate insertion of the apparatus into an inflatable device, wherein the at least one first component includes at least one LED system configured to generate the light, wherein the at least one LED system is configured such that the generated light includes variable multi-colored light, wherein the at least one LED system is configured to generate at least first radiation having a first wavelength and second radiation having a second wavelength different than the first wavelength, and wherein the at least one first component further comprises at least one controller coupled to the at least one LED system and configured to independently control a first intensity of the first radiation and a second intensity of the second radiation so as to generate the variable multi-colored light, the apparatus in a combination with the inflatable device, wherein the apparatus is configured such that when the apparatus is inserted into the inflatable device, the at least one of the light and the sound, when generated, is projected into an interior space of the inflatable device, wherein the inflatable device is a balloon, wherein the at least one second component includes a tether attachment feature, wherein the combination includes a tether coupled to the tether attachment feature, wherein the tether is formed of a side emitting fiber material, and wherein the at least one second component is configured such that at least some of the generated light is directed into the tether.

2. The apparatus of claim 1, wherein the at least one first component is configured to generate the at least one of the light and the sound in response to at least one detectable condition proximate to the apparatus.

3. The combination of claim 1, wherein the balloon includes at least one pattern on an exterior surface of the balloon.

4. The combination of claim 1, wherein the balloon includes confetti disposed in the interior space of the balloon.

5. The apparatus of claim 1, wherein the at least one controller is configured to control the at least one LED system so as to generate the light in response to at least one external signal received by the apparatus.

6. The apparatus of claim 5, wherein the at least one controller is configured to receive the at least one external signal via a wireless link.

7. The apparatus of claim 5, wherein the at least one controller is configured to receive the at least one external signal from a user interface device.

8. The apparatus of claim 5, wherein the at least one external signal indicates at least one detectable condition proximate to the apparatus.

9. The apparatus of claim 1, wherein:

the at least one first component further comprises at least one storage device coupled to the at least one controller and configured to store at least one illumination program; and the at least one controller is configured to execute the at least one illumination program so as to generate the light.

10. The apparatus of claim 1, wherein the at least one second component is adapted to accommodate at least one power source for the at least one first component.

11. The apparatus of claim 10, wherein the at least one second component includes a power switch to facilitate a coupling of the at least one power source to the at least one first component.

12. The apparatus of claim 1, wherein the at least one second component includes at least one passage to facilitate a transfer of a substance from outside of the inflatable device to inside of the inflatable device.

13. The apparatus of claim 12, wherein the at least one second component further includes at least one of a valve and a seal to facilitate control of the transfer of the substance through the passage.

14. The apparatus of claim 13, wherein the at least one of the valve and the seal includes a self-sealing mechanism.

15. The apparatus of claim 13, wherein the at least one of the valve and the seal includes a pressure sensitive device.

16. The apparatus of claim 15, wherein the at least one of the valve and the seal includes a spring loaded seal.

17. The apparatus of claim 1, wherein the at least one second component includes at least one formation adapted to facilitate a seal between the apparatus and the inflatable device.

18. A method of enhancing an inflatable device, comprising acts of:

projecting at least one of light and sound into an interior space of the inflatable device so as to enhance an effect of the inflatable device; and inserting at least one LED-based light source into the inflatable device such that light, when generated by the at least one LED-based light source, is projected into the interior space of the inflatable device, wherein the inflatable device includes an external tether, and wherein the method further comprises an act of projecting, from the external tether, at least some of the light generated by the at least one LED-based light source.

19. The apparatus of claim 1, wherein the at least one LED includes:

at least one first LED configured to generate the first radiation; and at least one second LED configured to generate the second radiation.

20. The apparatus of claim 1, wherein the at least one LED includes at least one semiconductor die configured to generate both the first radiation and the second radiation.

* * * * *